US006464389B1

(12) United States Patent
Ghoorahoo

(10) Patent No.: US 6,464,389 B1
(45) Date of Patent: Oct. 15, 2002

(54) COMBINED WATCH AND STORAGE CONTAINER

(76) Inventor: Raschid A. Ghoorahoo, 9762 Poplarwood Ct., Orlando, FL (US) 32825

( * ) Notice: Subject to any disclaimer, the term of this patent is extended or adjusted under 35 U.S.C. 154(b) by 0 days.

(21) Appl. No.: 09/569,632

(22) Filed: May 12, 2000

(51) Int. Cl.[7] ..... G04B 37/12
(52) U.S. Cl. ..... 368/278; 368/223; 368/283
(58) Field of Search ..... 368/10, 223, 283; 221/2, 3, 15, 154

(56) References Cited

U.S. PATENT DOCUMENTS

| | | | | | |
|---|---|---|---|---|---|
| 3,739,740 | A | | 6/1973 | Fromer | |
| 4,258,354 | A | * | 3/1981 | Carmon et al. | 368/10 |
| 4,483,626 | A | * | 11/1984 | Noble | 368/10 |
| 4,964,093 | A | * | 10/1990 | Hiranuma et al. | 368/283 |
| 5,020,037 | A | * | 5/1991 | Raven | 368/10 |
| 5,050,138 | A | * | 9/1991 | Yamada et al. | 368/10 |
| 5,157,640 | A | | 10/1992 | Backner | |
| 5,646,912 | A | | 7/1997 | Cousin | |
| 5,719,780 | A | | 2/1998 | Holmes et al. | |
| D398,862 | S | | 9/1998 | Craven | |
| 5,802,014 | A | | 9/1998 | Danko | |
| 5,915,558 | A | * | 6/1999 | Girvetz | 368/10 |
| 6,079,872 | A | * | 6/2000 | Besson | 368/281 |
| 6,198,695 | B1 | * | 3/2001 | Kirton et al. | 368/10 |
| 6,301,196 | B1 | * | 10/2001 | Daniel | 368/10 |
| 6,340,242 | B1 | * | 1/2002 | Sandidge | 368/10 |

FOREIGN PATENT DOCUMENTS

| | | | | |
|---|---|---|---|---|
| CA | 2132652 | * | 3/1996 | 368/10 |
| DE | 29720506 | * | 1/1998 | 368/10 |
| FR | 2518774 | * | 6/1983 | 368/10 |

* cited by examiner

*Primary Examiner*—Vit Miska
*Assistant Examiner*—Jeanne-Marguerite Goodwin

(57) ABSTRACT

A combined watch and storage container for alerting a user to take medication and to store the medication on the user's wrist. The combined watch and storage container includes a watch device. The watch device has a base portion. The base portion is a disc having a top surface. A cover portion is hingedly coupled to the base portion. Control circuitry is fixedly mounted in the cover portion. The control circuitry is adapted for tracking the time of the day. A display displays information from the control circuitry. The display is operationally coupled to the control circuitry. A wrist strap straps the base portion to the wrist of a user. A storage device has a housing having a bottom wall and a peripheral wall coupled to and extending away from a peripheral edge of the bottom wall. The bottom wall is mounted in the top surface of the base portion. The cover portion has a size adapted for covering the housing.

6 Claims, 2 Drawing Sheets

COMBINED WATCH AND STORAGE CONTAINER

BACKGROUND OF THE INVENTION

1. Field of the Invention

The present invention relates to medication timers and more particularly pertains to a new combined watch and storage container for alerting a user to take medication and to store the medication on the user's wrist.

2. Description of the Prior Art

The use of medication timers is known in the prior art. More specifically, medication timers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,802,014; 5,157,640; 5,646,912; 3,739,740; 5,719,780; and 398,862.

While these devices fulfill their respective, particular objectives and requirements, the aforementioned patents do not disclose a new combined watch and storage container. The inventive device includes a watch device. The watch device has a base portion. The base portion is a disc having a top surface. A cover portion is hingedly coupled to the base portion. Control circuitry is fixedly mounted in the cover portion. The control circuitry is adapted for tracking the time of the day. A display displays information from the control circuitry. The display is operationally coupled to the control circuitry. A wrist strap straps the base portion to the wrist of a user. A storage device has a housing having a bottom wall and a peripheral wall coupled to and extending away from a peripheral edge of the bottom wall. The bottom wall is mounted in the top :surface of the base portion. The cover portion has a size adapted for covering the housing.

In these respects, the combined watch and storage container according to the present invention substantially departs from the conventional concepts and designs of the prior art, and in so doing provides an apparatus primarily developed for the purpose of alerting a user to take medication and to store the medication on the user's wrist.

SUMMARY OF THE INVENTION.

In view of the foregoing disadvantages inherent in the known types of medication timers now present in the prior art, the present invention provides a new combined watch and storage container construction wherein the same can be utilized for alerting a user to take medication and to store the medication on the user's wrist.

The general purpose of the present invention, which will be described subsequently in greater detail, is to provide a new combined watch and storage container apparatus and method which has many of the advantages of the medication timers mentioned heretofore and many novel features that result in a new combined watch and storage container which is not anticipated, rendered obvious, suggested, or even implied by any of the prior art medication timers, either alone or in any combination thereof.

To attain this, the present invention generally comprises a watch device. The watch device has a base portion. The base portion is a disc having a top surface. A cover portion is hingedly coupled to the base portion. Control circuitry is fixedly mounted in the cover portion. The control circuitry is adapted for tracking the time of the day. A display displays information from the control circuitry. The display is operationally coupled to the control circuitry. A wrist strap straps the base portion to the wrist of a user. A storage device has a housing having a bottom wall and a peripheral wall coupled to and extending away from a peripheral edge of the bottom wall. The bottom wall is mounted in the top surface of the base portion. The cover portion has a size adapted for covering the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers:and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combined watch and storage container apparatus and method which has many of the advantages of the medication timers mentioned heretofore and many novel features that result in a new combined watch and storage container which is not anticipated, rendered obvious, suggested, or even implied by any of the prior art medication timers, either alone or in any combination thereof.

It is another object of the present invention to provide a new combined watch and storage container which may be easily and efficiently manufactured and marketed.

It is a further object of the present invention to provide a new combined watch and storage container which is of a durable and reliable construction.

An even further object of the, present invention is to provide a new combined watch and storage container which is susceptible of a low cost of manufacture with regard to both materials and labor, and which accordingly is then susceptible of low prices of sale to the consuming public, thereby making such combined watch and storage container economically available to the buying public.

Still yet another object of the present invention is to provide a new combined watch and storage container which provides in the apparatuses and methods of the prior art some of the advantages thereof, while simultaneously overcoming some of the disadvantages normally associated therewith.

Still another object of the present invention is to provide a new combined watch and storage container for alerting a user to take medication and to store the medication on the user's wrist. Yet another object of the present invention is to provide a new combined watch and storage container which includes a watch device. The watch device has a base portion. The base portion is a disc having a top surface. A cover portion is hingedly coupled to the base portion. Control circuitry is fixedly mounted in the cover portion. The control circuitry is adapted for tracking the time of The day. A display displays information from the control circuitry. The display is operationally coupled to the control circuitry. A wrist strap straps the base portion to the wrist of a user. A storage device has a housing having a bottom wall and a peripheral wall coupled to and extending away from a peripheral edge of the bottom wall. The bottom wall is mounted in the top surface of the base portion. The cover portion has a size adapted for covering the housing.

Still yet another object of the present invention is to provide a new combined watch and storage:container that contains an alarm for alerting the user of the need to take medication.

Even still another object of the present invention is to provide a new combined watch and storage container that contains a storage device having compartments therein for storing medications to be taken at different times.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the: annexed drawings wherein.

DESCRIPTION OF THE PREFERRED EMBODIMENT

Figure 1:
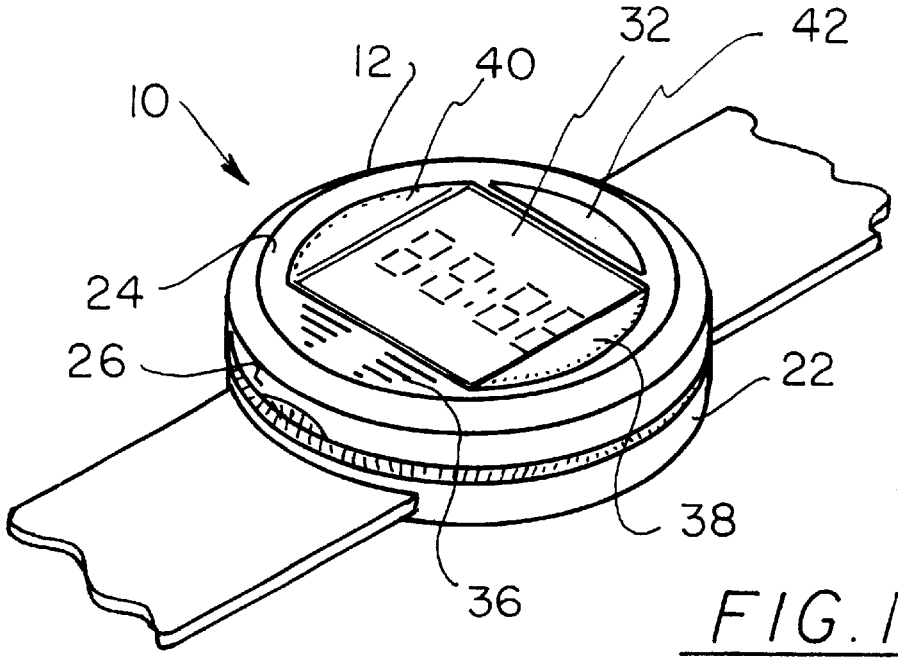
FIG. 1 is a schematic perspective view of a new combined watch and storage container according to the present invention.
Figure 2:
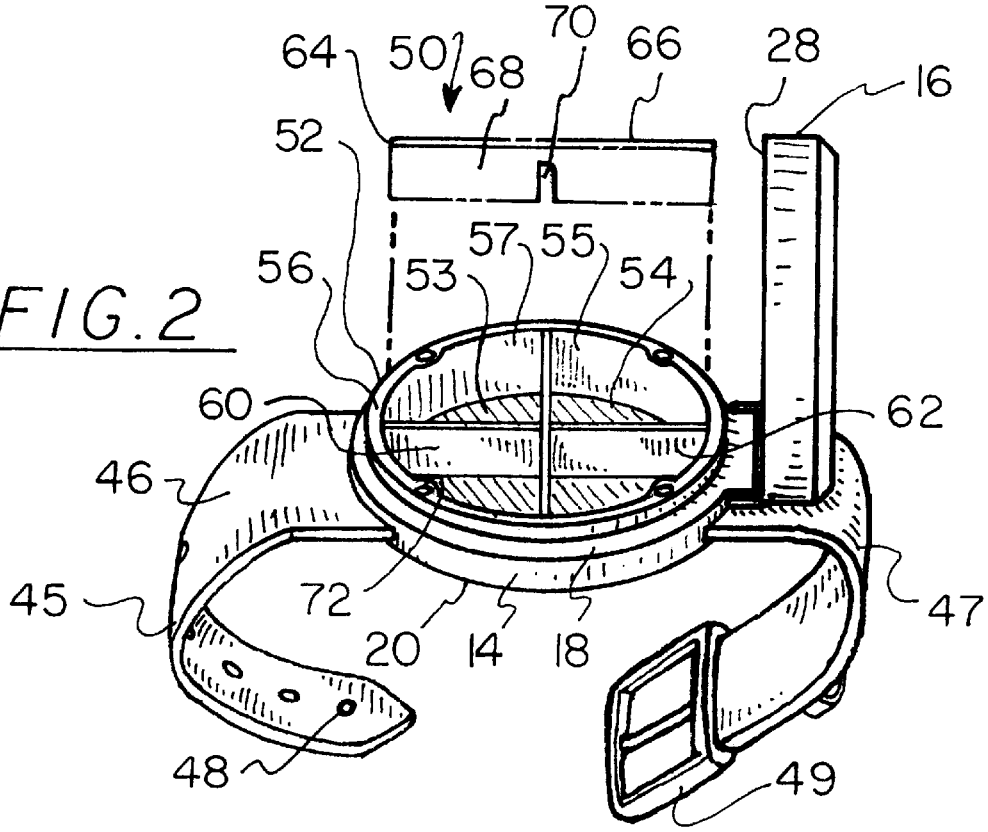
FIG. 2 is a schematic perspective view of the present invention.
Figure 3:
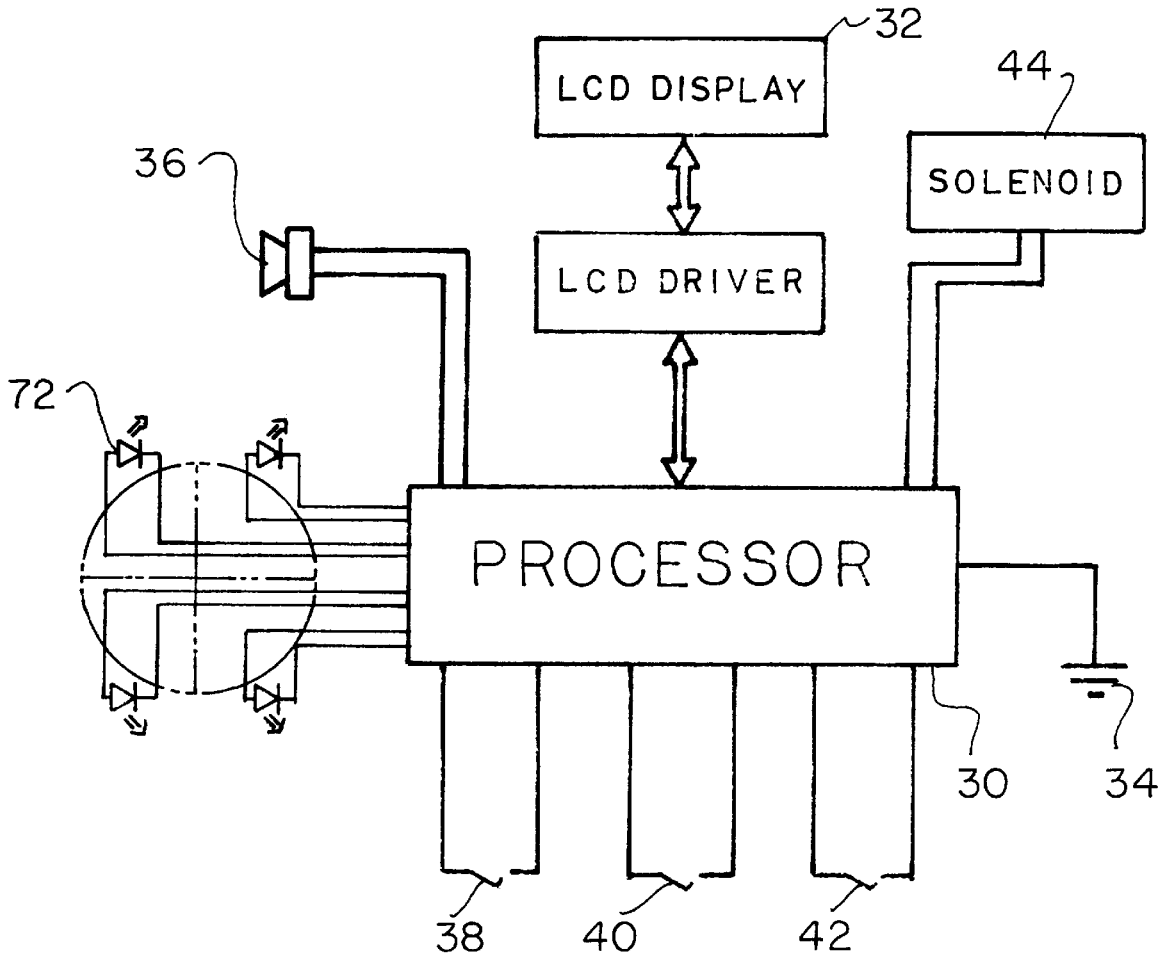
FIG. 3 is a electronic schematic of the present invention.

With reference now to the drawings, and in particular to FIGS. 1 through 3 thereof, a new combined watch and storage container embodying the principles and concepts of the present invention and generally designated by the reference numeral 10 will be described.

As best illustrated in FIGS. 1 through 3, the combined watch and storage container 10 generally comprises a watch device 12 and a storage device 50.

The watch device 12 comprises a base portion 14 and a cover portion 16. The base portion 14 is generally a disc. The disc 14 has a top surface 18, a bottom surface 20 and a peripheral edge 22. The top surface 18 has a generally circular shape. The cover portion 16 has a wall 24 having an annular lip 26 extending away therefrom. The annular lip 26 has a free edge 28, which is hingedly coupled to the peripheral edge 22 of the base portion 14. The wall 24 of the cover portion has a diameter substantially equal to the top surface 18 of the base portion 14. The lip 26 and the wall 24 define an interior space of the cover portion.

Control circuitry 30 is fixedly mounted in the wall 24 of the cover portion 16. The control circuitry 30 is adapted for tracking the time of the day and for sounding an alarm. The control circuitry comprises a microprocessor.

A display 32 displays information from the control circuitry. The display 32 is mounted on the control circuitry 30, and a surface of the display is generally flush with a top surface of the wall 24 of the cover portion 16. The display 32 is operationally coupled to the control circuitry 30. The display comprises a liquid crystal display. The display has a light, not shown, therein.

A power source 34 powers the control circuitry and operationally coupled thereto. Ideally, the power source is a battery.

A speaker 36, or alarm, produces a sound for alerting a user to take medication. The speaker 36 is mounted in the wall 24 of the cover portion 16 and is operationally coupled to the control circuitry 30.

Three buttons are mounted in the top surface of the wall 24 of the cover portion 16. Each of the three buttons is operationally coupled to the control circuitry 30. A first 38 and second 40 of the buttons are adapted for programming the control circuitry 30. A third 42 of the buttons is adapted :for actuating the light for illuminating the display 32.

A vibrating means 44 for vibrating the base portion 14 also alerts the user when medication into be taken. The vibrating means 44 may be used in conjunction with or separately from the speaker 36 alarm. The vibrating means 44 is mounted in the base portion 14. The vibrating means 44 is operationally coupled to the control circuitry 30 and preferably comprises a solenoid.

A wrist strap 45 straps the base portion 14 to the wrist of a user. The wrist strap 45 includes a first 46 and second 47 strap. The first strap 46 has a first end fixedly coupled to the peripheral edge 20 of the base portion 14. The first strap 46 has a plurality of apertures 48 therein. The second strap 47 has a first end fixedly coupled to the peripheral edge 20 of the base portion 14. The first strap is orientated generally opposed to the second strap. The second strap 47 has a buckle 49 thereon for selectively coupling with the apertures 48 in the first strap 46.

The storage device 50 includes a housing 52. The housing 52 has a bottom wall 53, and a peripheral wall 55 coupled to and extending away from a peripheral edge 54 of the bottom wall 53. The bottom wall 53 is mounted in the top surface 18 of the base portion 14. The peripheral wall 55,has a free edge 56 and an internal surface 57. The bottom wall 53 has a generally circular shape. The cover portion 16 has a size adapted to fit over the housing 52.

A first dividing wall 60 divides the housing 52. The first dividing wall 60 has a first end and a second end each fixedly coupled to the internal surface 57.of the peripheral wall 55. The first dividing wall 60 generally extends along a line bisecting the housing 52.

A second dividing wall 62 also divides the housing 52. The second dividing wall 62 has a first end and a second end each fixedly coupled to the internal surface 57 of the peripheral wall 55. The second dividing wall 62 generally extends along a line bisecting the housing 52. The first dividing wall 60 is orientated generally perpendicular to the second dividing wall 62. The first and second dividing walls define four compartments.

A covering member 64 for the housing 52 has a top wall 66 having a peripheral wall 68 extending therefrom. The top wall 66 has a perimeter length substantially equal to a perimeter length of the internal surface 57 of the peripheral wall 55 of the housing 52. The peripheral wall 68 of the covering member 64 has notches 70 therein, which are generally located for receiving the first 60 and second 62 dividing walls when the covering member 64 is placed on the housing 52.

A plurality of light indicators, 72 indicates which compartment contains the required medication. Each of the light indicators 72 is mounted in and generally flush to the free edge 56 of the peripheral wall 55 of the housing 52. Each of the light indicators 72 is generally adjacent to one of the compartments. Each of the light indicators 72 is operationally coupled to the control circuitry 30.

In use, medication is placed in the storage device 50. Using the buttons 38, 40 the control circuitry 30 is programmed to signal the user via the vibrating means 44 or alarm 36 that medication is to be taken. The lights 72 in the free edge 56 of the peripheral wall 55 of the housing 52 indicate which compartmentalized medication is to be taken.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combined watch and storage container for tracking times of medication use, said combined watch and storage container comprising:

a watch device, said watch device comprising:

a base portion, said base portion including a disc, said disc having a top surface, a bottom surface and a peripheral edge, said top surface having a generally circular shape;

a cover portion, said cover portion having a wall having an annular lip extending away therefrom, said annular lip having a free edge, said free edge being hingedly coupled to said peripheral edge of said base portion, said wall of said cover portion having a diameter substantially equal to said top surface of said base portion, an interior space of said cover portion being defined by said lip and said wall;

control circuitry being fixedly mounted in said wall of said cover portion, said control circuitry being adapted for tracking the time of the day, and for sounding an alarm, said control circuitry comprising a microprocessor;

a display for displaying information from said control circuitry, said display being mounted on said control circuitry, a surface of said display being generally flush with a top surface of said wall of said cover portion, said display being operationally coupled to said control circuitry, said display comprising a liquid crystal display, said display having a light therein;

a speaker for producing a sound, said speaker being mounted in said wall of said cover portion, said speaker being operationally coupled to said control circuitry;

three buttons mounted in an upper surface of said wall of said cover portion, each of said three buttons being operationally coupled to said control circuitry, a first and second of said buttons being adapted for programming said control circuitry, a third of said buttons adapted for actuating said light for illuminating said display;

a vibrating means for vibrating said base portion, said vibrating means being mounted in said base portion, said vibrating means being operationally coupled to said control circuitry, said vibrating means comprising a solenoid;

a wrist strap for strapping said base portion to the wrist of a user, said wrist strap comprising a first and second strap, said first strap having a first end fixedly coupled to said peripheral edge of said base portion, said first strap having a plurality of apertures therein, said second strap having a first end being fixedly coupled to said peripheral edge of said base portion, said first strap being orientated generally opposed to said second strap, said second strap having a buckle thereon for selectively coupling with said apertures in said first strap;

a storage device, said storage device comprising:

a housing, said housing having a bottom wall, and a peripheral wall coupled to and extending away from a peripheral edge of said bottom wall, said bottom wall being mounted in said top surface of said base portion, said peripheral wall having a free edge and an internal surface, said bottom wall having a generally circular shape;

a first dividing wall for dividing said housing, said first dividing wall has a first end and a second end each being fixedly coupled to said internal surface of said peripheral wall, said first dividing wall generally extending along a line bisecting said housing;

a second dividing wall for dividing said housing, said second dividing wall has a first end and a second end each being fixedly coupled to said internal surface of said peripheral wall, said second dividing wall generally extending along a line bisecting said housing, said first dividing wall being orientated generally perpendicular to said second dividing wall, wherein said first and second dividing walls define four compartments;

a covering member for said housing, said covering member having a top wall having a peripheral wall extending therefrom, said top wall having a perimeter length substantially equal to a perimeter length of said internal surface of said peripheral wall of said housing, said peripheral wall of said covering member having notches therein, said notches being generally located for receiving said first and second dividing walls when said covering member is placed on said housing;

a plurality of light indicators for indicating which compartment contains the required medication, each of said light indicators being mounted in and generally flush to said free edge of said peripheral wall of said housing, each of said light indicators being generally adjacent to one of said compartments, each of said light indicators being operationally coupled to said control circuitry;

wherein said cover portion has a size adapted to fit over said housing.

2. A combined watch and, storage container for tracking times of medication use, said combined watch and storage container comprising:

a watch device including:

a base portion having a top surface;

a cover portion being hingedly coupled to said base portion;

control circuitry being fixedly mounted in said cover portion, said control circuitry being adapted for tracking the time of the day, said control circuitry being adapted for sounding an alarm;

a speaker said for producing a sound being mounted in said wall of said cover portion and being operationally coupled to said control circuitry;

a display for displaying information from said control circuitry being operationally coupled to said control circuitry;

a wrist strap for strapping said base portion to the wrist of a user; and a storage device, said storage device comprising:

a housing, said housing having a bottom wall, and a peripheral wall coupled to and extending away from a peripheral edge of said bottom wall, said bottom wall being mounted in said top surface of said base portion, said cover portion having a size adapted for covering said housing, said peripheral wall of said housing having a free edge and an internal surface, said bottom wall having a generally circular shape;

a plurality of intersecting dividing walls for dividing said housing into a plurality of compartments, each of said dividing walls having a first end and a second end each being fixedly coupled to said internal surface of said peripheral wall, each of said dividing walls generally extending along lines bisecting said housing; and a covering member for said housing having a top wall having a peripheral wall extending therefrom, said top wall having a perimeter length substantially equal to a perimeter length of said internal surface of said peripheral wall of said housing, said peripheral wall of said covering member having notches therein, said notches being generally located for receiving said dividing walls when said covering member is placed on said housing.

3. The combined watch and storage container as in claim 2, wherein said base portion comprises a disc having a bottom surface and a peripheral edge, said top surface having a generally circular shape, said cover portion having a wall having an annular lip extending away therefrom, said annular lip having a free edge, said free edge being hingedly coupled to said peripheral edge of said base portion, said wall of said cover portion having a diameter substantially equal to said top surface of said base portion, an interior space of said cover portion being defined by said lip and said wall.

4. The combined watch and storage container as in claim 2, further comprising three buttons mounted on of said cover portion, each of said three buttons being operationally coupled to said control circuitry, a first and second of said buttons being adapted for programming said control circuitry, a third of said buttons adapted for actuating said light for illuminating said display.

5. The combined watch and storage container as in claim 2, said watch device further comprising a vibrating means for vibrating said base portion, said vibrating means being mounted in said base portion, said vibrating means being operationally coupled to said control circuitry.

6. The combined watch and storage container as in claim 2, said storage device further comprising:

a plurality of light indicators for indicating which compartment contains the required medication, each of said light indicators being mounted in and generally flush to said free edge of said peripheral wall of said housing, each of said light indicators being generally adjacent to one of said compartments, each of said light indicators being operationally coupled to said control circuitry.

* * * * *